United States Patent [19]

Ward

[11] 4,214,510

[45] Jul. 29, 1980

[54] VENT AND BAFFLE UNIT

[76] Inventor: Bruce K. Ward, 2904 Virginia Ave. South, Minneapolis, Minn. 55426

[21] Appl. No.: 942,462

[22] Filed: Sep. 14, 1978

[51] Int. Cl.[2] ..... F24F 7/00

[52] U.S. Cl. ..... 98/37; 98/32; 98/42 R; 52/92; 52/198; 52/95

[58] Field of Search ..... 98/33 R, 37, 42 A, 32; 52/92, 95, 199, 198, 303; D23/139, 151, 153, 163

[56] References Cited

U.S. PATENT DOCUMENTS

| | | | |
|---|---|---|---|
| 27,872 | 4/1860 | Walcott | 52/303 |
| D. 221,251 | 7/1971 | Haskell | D54/2 |
| D. 247,628 | 3/1978 | Ward | D23/137 |
| 279,977 | 6/1883 | Parker | 285/300 |
| 332,491 | 12/1885 | Clay | 52/630 |
| 1,523,970 | 1/1925 | Jakob | 52/407 |
| 2,283,257 | 5/1942 | Jorsch | 52/407 X |
| 2,318,820 | 5/1943 | Voight et al. | 52/303 |
| 2,477,152 | 7/1949 | Stevenson | 52/199 X |
| 2,601,905 | 7/1952 | Anderegg | 98/31 X |
| 2,641,449 | 6/1953 | Antony | 165/47 |
| 2,954,727 | 10/1960 | Katt et al. | 98/33 |
| 3,160,987 | 12/1964 | Pinkley | 52/407 X |
| 3,186,524 | 6/1965 | Spaeth, Jr. | 52/630 X |
| 3,196,773 | 7/1965 | Lorenz et al. | 98/32 |
| 3,236,170 | 2/1966 | Meyer et al. | 52/22 X |
| 3,240,144 | 3/1966 | Lind | 98/42 X |
| 3,633,659 | 1/1972 | Ohlsson | 165/56 |
| 3,683,785 | 8/1972 | Grange | 52/92 X |
| 3,777,649 | 12/1973 | Luckey | 98/37 |
| 3,797,180 | 3/1974 | Grange | 52/95 |
| 3,863,553 | 2/1975 | Koontz | 52/95 X |
| 3,972,164 | 8/1976 | Grange | 52/92 X |
| 4,102,092 | 7/1978 | Ward | 52/92 |

FOREIGN PATENT DOCUMENTS

| | | | |
|---|---|---|---|
| 558814 | 6/1958 | Canada | 52/303 |

OTHER PUBLICATIONS

Van Huffel Catalog, Jan. 1953, pp. 16, 17, 28, 31.
Dahlstrom Manufacturing Corp. Catalog, pp. 17, 24, 25, 30, 102, 116.
Flex-O-Vent Publication Leedon Company.

*Primary Examiner*—Albert J. Makay
*Assistant Examiner*—Henry Bennett
*Attorney, Agent, or Firm*—Burd, Bartz & Gutenkauf

[57] ABSTRACT

A vent and baffle unit locatable between adjacent roof rafters of a structure to provide a passage for the flow of air from the soffit to the attic and block the normal opening between the soffit and attic. The vent and baffle unit has a vent section having a triangular base and triangular side walls. Flanges are articuately joined to the outer edges of the side walls. The vent section can be folded into a generally V-shaped configuration. The inlet to the vent section has a generally rectangular cross sectional area. The outlet has a triangular cross sectional area. The baffle is articuately connected to the front of the vent section. The baffle is folded in a downward direction to block the normal opening between the attic and the soffit. The vent and baffle unit can be folded in an inward direction to provide a narrow configuration allowing it to be used with 16" on center roof rafters. Alternatively, the vent and baffle unit can be folded in an outward direction which allows the vent and baffle unit to be used with 24" on center roof rafters.

34 Claims, 10 Drawing Figures

VENT AND BAFFLE UNIT

SUMMARY OF INVENTION

The invention is directed to a structure to provide air ventilation for an attic of a building. The structure is a vent and baffle unit usable between adjacent roof rafters of the building to provide an air flow passage between the soffit and the attic. It is a conventional and desirable practice to use insulation material in the attic of a building to reduce heat loss from the building. When insulation is used in the attic, there must be ventilating openings to provide for the air flow through the attic. The air prevents the accumulation of moisture in the attic and removes excess heat from the attic. The roof rafters of buildings are normally located either 16" or 24" on center arrangement to support the roof boards or panels and the roofing. With these rafter arrangements, the openings between the attic and the soffit adjacent the top plate vary in size. The vent and baffle unit of the invention is usable with both the 16" and 24" on center rafter arrangements to block the openings between adjacent roof rafters and provide ventilating passages between the soffit and attic.

The vent and baffle unit is a one-piece sheet member that is manufactured and shipped in a flat compact condition. The flat shape of the vent and baffle unit contributes to the relatively low manufacturing and shipping costs and ease of handling. The vent and baffle unit has a vent section and a baffle section. The vent section has a generally triangular base or bottom wall articuately connected to generally triangular side walls. Elongated flanges are articuately connected to the outer edges of the side walls. The base and side walls are folded into a generally V-shaped configuration which provides the vent section with strength when assembled between adjacent roof rafters. The side flanges are folded in an inward direction to provide a narrow vent. The outlet portions of the flanges overlap each other and are adapted to receive a fastener attaching the flanges to the roof boards. The side flanges are folded in opposite outward directions thereby providing the vent section with a wide shape.

The baffle section has a transverse main body articuately connected to the inlet end of the base of the vent. A transverse lip is articulately connected to the outer transverse edges of the main body. The baffle body has side sections that are articuately connected to the opposite ends of the main body of the baffle to provide the baffle with its maximum length. Triangular sections join the side sections of the baffle to the flanges and sidc wall. A groove or cut separates a substantial portion of the material between the triangular section and the flanges and side walls leaving a linear hinge connection. The hinge connection allows the side flanges to fold back the adjacent top of the flanges and the side walls when the vent is in its narrow configuration. This vent and baffle structure allows the same one-piece vent and baffle to be used with both the 16" and 24" on center rafter arrangements of buildings.

IN THE DRAWINGS

DESCRIPTION OF PREFERRED EMBODIMENT

Figure 3:
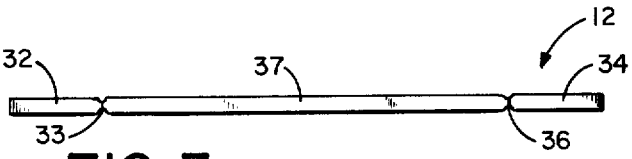
FIG. 3 is an end view of the baffle end of FIG. 1.
Figure 1:
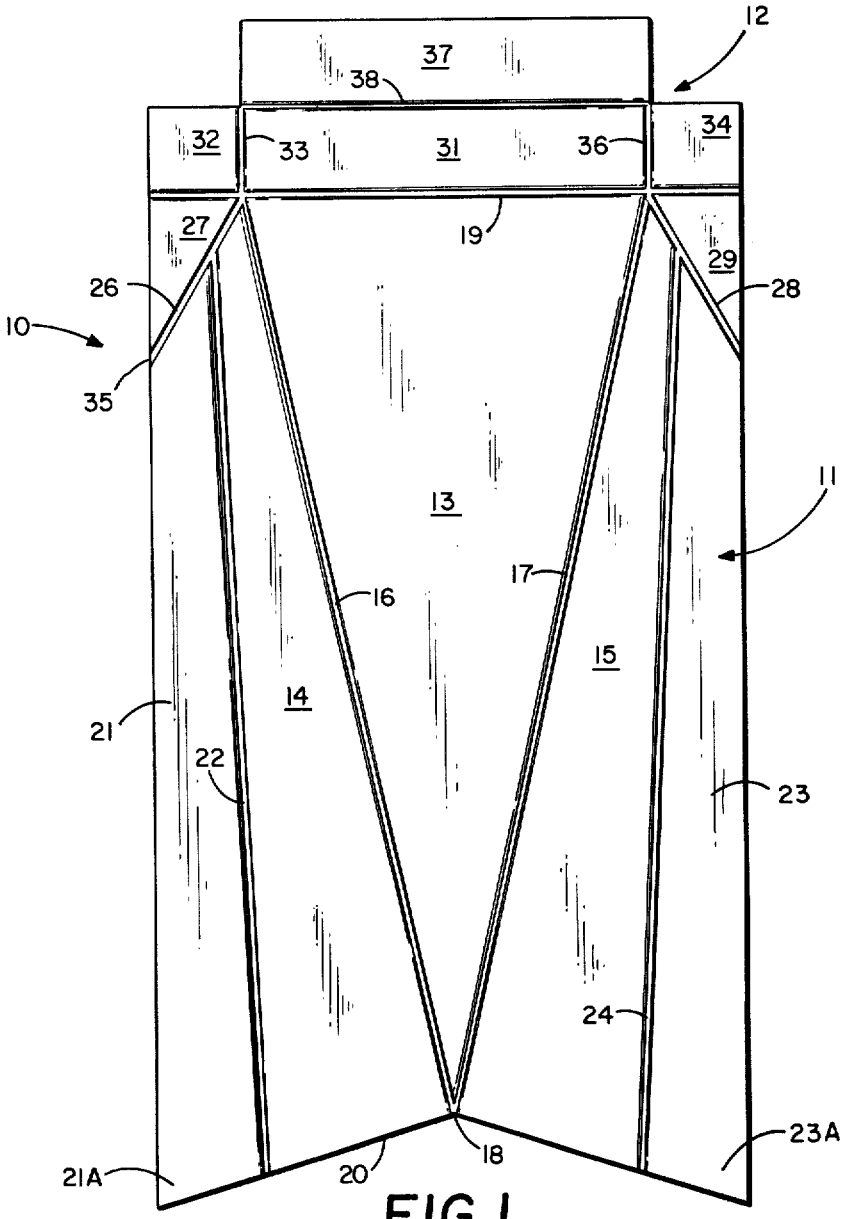
FIG. 1 is a plan view of the blank of the combined vent and baffle unit of invention.

Referring to FIGS. 1–4, there is shown a combined vent and baffle unit of the invention indicated generally at 10. Unit 10 is shown in the blank or flat form. Unit 10 can be made of flat sheet material, such as cardboard, sheet foamed plastic, metals, sheet metal, sheet aluminum, particle board, plywood, or like materials. The materials can be treated or contain fire retardant substances or materials.

The vent and baffle unit 10 has a vent section 11 and a baffle section 12 articuately connected to the inlet or forward end of vent section 11. Vent section 11 has a base or bottom wall 13 of a triangular shape. The sides of the triangular bottom wall are equal in length. The included angles at the base of the triangle are equal. The base of the triangle is articuately connected to baffle section 12 with a transverse crease or score 19. Generally triangular side walls 14 and 15 are articuately connected with creases or scores 16 and 17 to the opposite sides of triangular shaped bottom wall 13. The creases or scores 16 and 17 are joined to each other at an apex point 18. The exit or rear end 20 of vent section 11 has a broad V-shaped recess with point 18 being the center of the V.

A first side flange 21 is articuately connected to the outside edge of side wall 14 with a linear crease or score 22. Score 22 has a slight rearwardly converging angle with respect to the longitudinal axis of the vent section. A second side flange 23 is articuately joined with a crease or score 24 to the outside edge of side wall 15. Crease 24 tapers inwardly in the same manner as crease 22. This provides the flanges 21 and 23 with rear portions 21A and 23A which can be folded over each other to accommodate a fastener to attach the flanges to the roof boards of a structure. The V-shaped recess formed by end 20 allows end sections 21A and 23A to extend rearwardly from side walls 14 and 15 when folded over each other.

Figure 2:
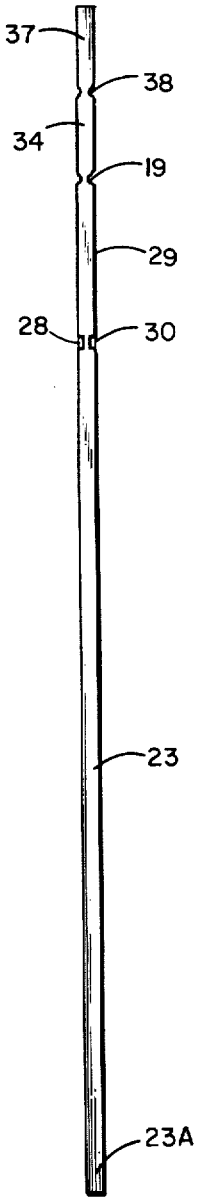
FIG. 2 is a side view of the right side of FIG. 1.
Figure 4:
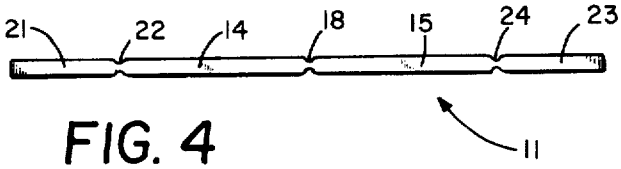
FIG. 4 is an end view of the vent end of FIG. 1.

A continuous cut or groove 26 separates the upper or inlet portions of side wall 14 and flange 21 from a right triangular section 27. The transverse crease 19 articuately connects triangular section 27 to a side portion 32 of the baffle 12. A second inclined groove or continuous cut 28 separates the forward portions of side wall 15 and flange 23 from a second right triangular section 29. Crease 19 articuately connects right triangular section 29 to the right portion 34 of the baffle. A longitudinal crease 33 separates the baffle portion 32 from the main baffle body 31. In a similar manner, a longitudinal crease 36 articuately connects baffle portion 34 to baffle body 31. As shown in FIG. 2, the groove 28 extends substantially through the thickness of the vent material leaving a small or thin hinge connection 30. Hinge connection 30 allows the triangular portion 29 to be bent back over the top side of flange 23 when the flange is folded in an inward direction along the crease line 24. A hinge connection 35 articuately connects triangular portion 27 to the forward ends of side wall 14 and flange 21. Hinge connection 35 allows triangular portion 27 to be bent back over the top side of flange 23 when the flange is folded inward along line 22. This is shown in FIG. 6.

A rectangular shaped lip or panel 37 is located adjacent the forward edge of main baffle body 31. A transverse crease or score line 38 articuately connects the adjacent edges of main body 31 in lip 37 thereby allowing the lip 37 to be bent at approximately right angles to the main baffle body 31.

Figure 5:
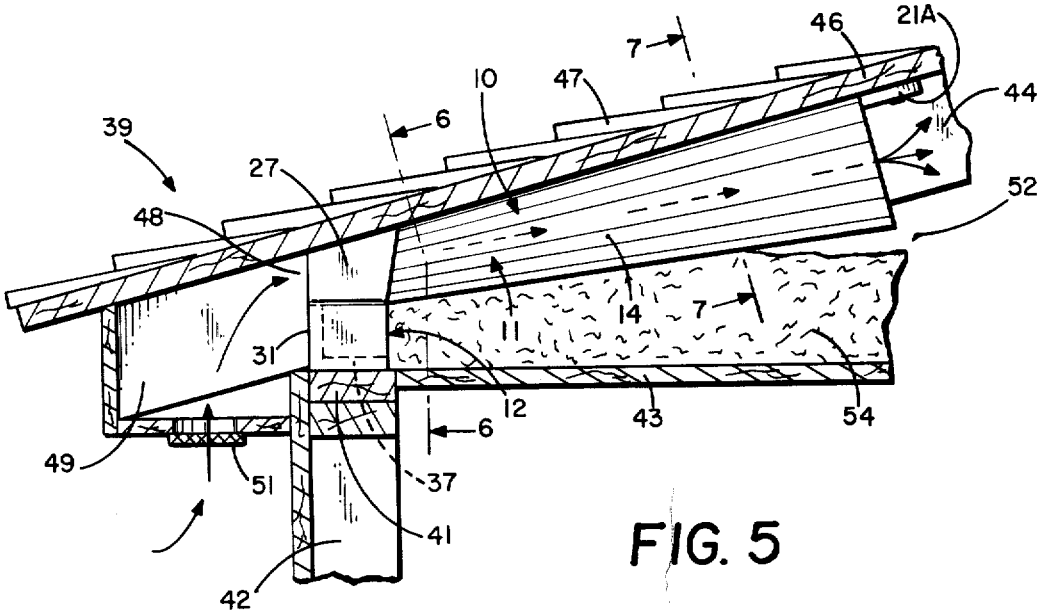
FIG. 5 is a side view of the combined vent and baffle unit located in a roof of a structure, shown in section, having 16" on center roof rafters.
Figure 6:
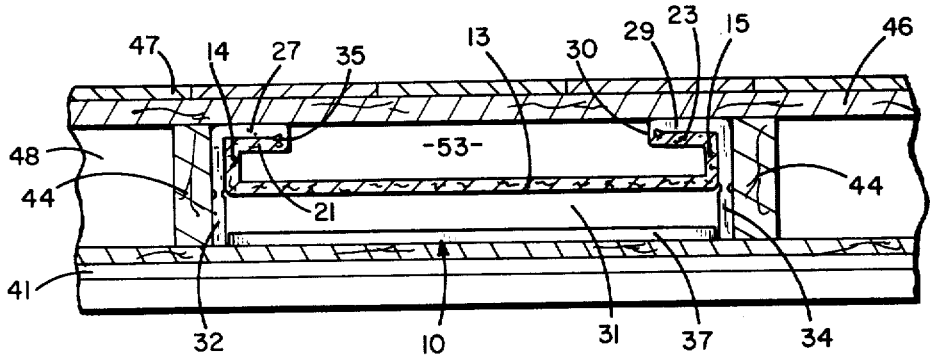
FIG. 6 is a sectional view taken along line 6—6 of FIG. 5.
Figure 7:
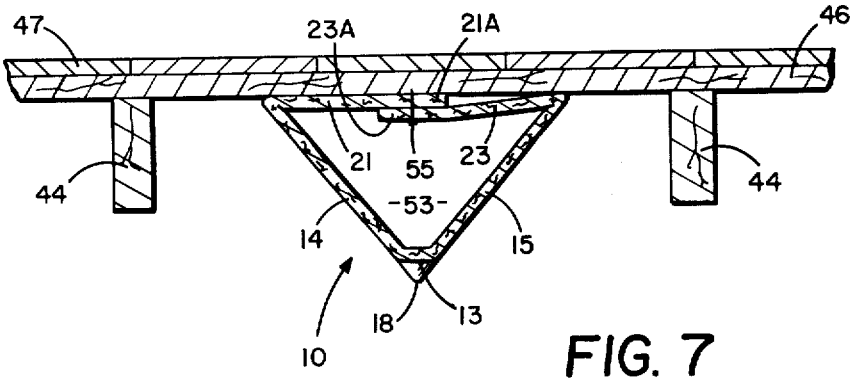
FIG. 7 is a sectional view taken along line 7—7 of FIG. 5.

Referring to FIGS. 5–7, vent and baffle unit 10 is shown in its narrow configuration in assembled relation with a structure or building indicated generally at 39 to block the normal opening and provide a vent passage from the soffit to the attic of the building. Building 39 can be an industrial or a residential building, including a home, office, and like structures. Building 39 has the conventional top plate 41 located on top of an upright wall 42. A generally horizontal ceiling 43 extends inwardly from top plate 41. Roof rafters 44 extend upwardly from the top plate 41 and support the roof boards or panels 46. Conventional roofing 47 is attached to the top of the roof boards 46. The structure has the conventional openings 48 between the roof boards and the top plate 41 and adjacent roof rafters 44 which provide for the movement of air from soffit 49 to attic space 51. Soffit 49 has a ventilator 51 allowing air to move into the soffit space from below the roof overhang. The vent and baffle unit 10, when assembled below roof boards 46, provides an air passage 53 for allowing air to move from soffit 49 to the attic 52. The vent and baffle unit allows insulation 55 to be placed above ceiling 43 and adjacent the wall plate 41. The baffle section 31 extends upwardly from plate 41 and the lip 37 rests on plate 41. Baffle 31 prevents the insulation 55 from being blown into and closing soffit 49.

Vent and baffle unit 10 is installed between adjacent roof rafters 44. The roof rafters 44 are shown in FIGS. 5–7 and are 16" on center so that the vent and baffle structure is folded to its narrowest shape. The flanges 21 and 23 are folded in inwardly facing directions with the end portions 21A and 23A overlapped. A fastener 55, such as a staple or nail, attaches the overlapped sections 21A and 23A to the roof boards 26. The side walls 14 and 15 are at an inclined shape forming the passage 53. Passage 53 at the inward end has a generally rectangular shape. At the outlet end passage 53 has a generally triangular shape. The cross sectional areas of the inlet and outlet ends of the passage are approximately the same so that the side walls 14 and 15 and bottom wall 13 is not a restricted passage which interferes with the flow of air through passage 53.

As shown in FIG. 6, the main body 31 of the baffle extends between the roof rafter 44 and space 48 below passage 53. The triangular section 27 is bent along the hinge 35 over the top of flange 14 and flange 21 around the side wall 14. The baffle section 32 is folded back adjacent the inside of roof rafter 41. The triangular section 29 is articuately connected to the hinge connection 30 over the top of flange 23 and adjacent the outside of the side wall 15. Baffle section 31 extends rearwardly adjacent the inside of the roof rafter.

Figure 8:
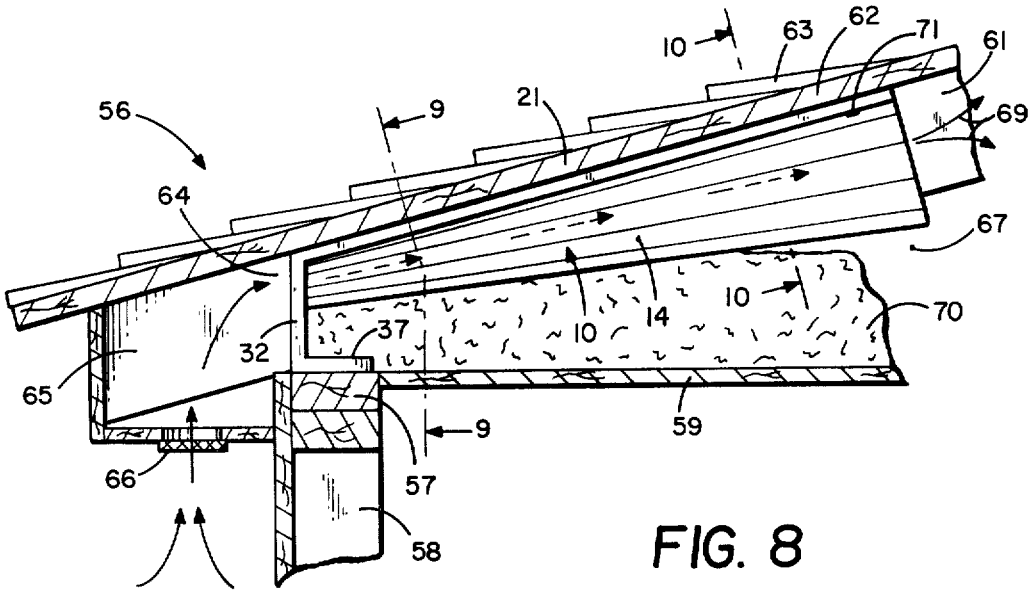
FIG. 8 is a side view of the combined vent and baffle unit located in a roof of a structure, shown in section, having 24" on center roof rafters.
Figure 9:
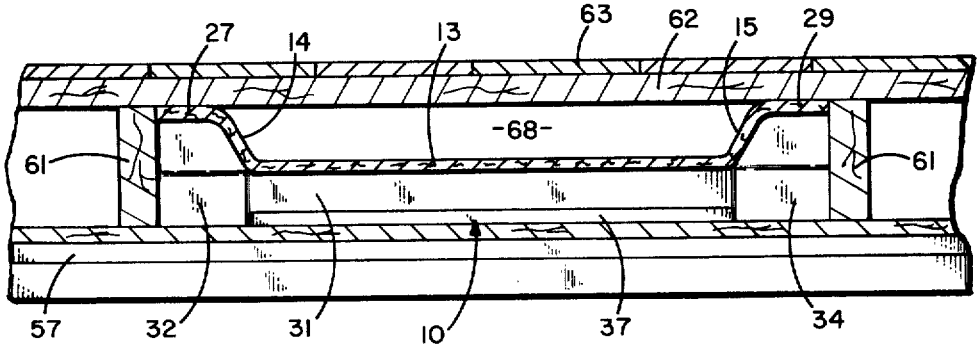
FIG. 9 is a sectional view taken along line 9—9 of FIG. 8.
Figure 10:
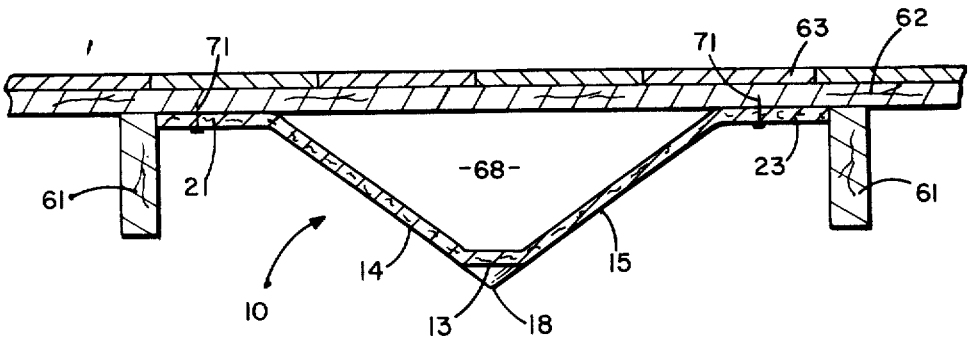
FIG. 10 is a sectional view taken along line 10—10 of FIG. 8.

Referring to FIGS. 8–10, there is shown a building or structure indicated generally at 56 in association with the vent and baffle unit 10 formed into its wide position. Building 56 has a top plate 57 supported by an upright wall 58. Ceiling 59 extends inwardly from top plate 57. A plurality of upwardly inclined roof rafters 61 support the roof boards 62. The roof rafters 61 are located on 24" centers providing openings 64 from the soffit 65 to the attic 67. Ventilator 66 is located on the bottom of the soffit structure and provides an opening for outside air to move through the soffit 65 into the attic 67. The vent and baffle unit 10 forms with the roof boards 62 an air ventilating passage 68 allowing the air to flow as indicated by the arrows 69 from soffit 65 to attic 67.

In use, vent and baffle unit 10 is placed between adjacent roof rafters 61 to provide a barrier for the insulation 70 located above the ceiling 59 and adjacent the top plate 57. The vent passage 68 is maintained to insure the flow of air from soffit 65 to attic 67. The baffle portions or sections 31, 32, and 34 are folded in a downward direction. Lip 39 is folded in a rearward direction so that it rests on top of the top plate 57. The baffle portions 31, 32, and 34 extend between the adjacent roof rafters 61, as shown in FIG. 9. The flanges 21 and 23 are folded in an outward direction and engage the inside of roof boards 62. A plurality of fasteners 71, as nails, staples, and the like, are used to attach the flanges 21–23 to the roof boards. The triangular sections 27 and 29 also engage the bottom of roof boards 62. Passage 68 has a generally rectangular shape at the inlet end of the vent and baffle unit 10, as shown in FIG. 9. The passage gradually changes to a triangular shape at the outlet end, as shown in FIG. 10. The triangular shape of the side walls 14 and 15 and the triangular shape of the bottom wall 13 provides the vent section 11 with structural strength so that it will not collapse or shift when the insulation is piled against the vent section 12.

The vent and baffle unit 10 is installed without special tools in new and existing structures. The installation is done with a minimum of time and labor. The baffle section 12 effectively blocks the passage between the soffit and attic to prevent insulation from being inadvertently blown into the soffit area, thereby blocking the flow of air into the attic. The shape of the vent section 11 adjacent the baffle section 12, being generally rectangular, provides for the maximum amount of insulation adjacent the top plate, thereby increasing the insulating efficiency at the corners of the structure.

The vent and baffle unit is usable with both 16" and 24" on center rafter arrangements of the buildings. The vent section and baffle section does not have to be cut or altered to fit into the wide and narrow rafter arrangements by changing the folding direction of the side flanges 21 and 23.

While there has been shown and described the preferred embodiment of the vent and baffle unit, it is understood that changes in the structure, materials, and sizes of the components of the structure may be made by those skilled in the art without departing from the invention. The invention is defined in the following Claims.

The embodiments of the invention in which an exclusive property or privilege is claimed are defined as follows:

1. A vent and baffle unit for use with a structure having adjacent roof rafters extended from a top plate to support roof structure and an opening between the adjacent roof rafters connecting the soffit and attic comprising: a one-piece sheet member having a vent section providing an air passage between the soffit and the attic and a baffle section closing the opening between the adjacent roof rafters at the forward end of the vent section, except for the air passage, said vent section including a bottom wall having opposite sides and a forward edge, said bottom wall has a generally triangular shape with opposite sides thereof diverging away from the baffle means, side walls articuately joined to the opposite sides of the bottom wall, a first flange articuately joined to one side wall, a second flange articuately joined to the other side wall, said baffle section including a transverse baffle means articuately joined to the forward edge of the bottom wall, said side walls of the vent section being angularly related to the bottom wall to form the vent passage and said first and second flanges being attachable to the roof structure, said baffle means of the baffle section being extended downwardly from the forward edge of the bottom wall to close the opening between adjacent roof rafters below the forward edge of the bottom wall.

2. The vent and baffle unit of claim 1 including: a transverse lip articuately connected to the baffle means, said lip adapted to engage the top plate when the baffle means is located between adjacent roof rafters to close the opening between the soffit and the attic.

3. The vent and baffle unit of claim 1 wherein: the side walls each have a generally triangular shape and outside edges articuately joined to a flange.

4. The vent and baffle unit of claim 3 including: a first triangular section located adjacent the forward ends of the first flange and adjacent side wall, a first hinge connection movably connecting the first triangular section to the forward ends of the first flange and adjacent side wall, a second triangular section located adjacent the forward ends of the second flange and adjacent side wall, and a second hinge connection movably connecting the second triangular section to the forward ends of the second flange and adjacent side wall, said first and second hinge connections allowing the first and second flanges to be folded in inward facing direction whereby the vent section has a minimum width and allowing the flanges to be folded in an opposite outward direction whereby the vent section has a maximum width.

5. The vent and baffle unit of claim 1 wherein: each flange is an elongated generally rectangular flat member.

6. The vent and baffle unit of claim 1 wherein: the baffle means includes a baffle body, a first baffle portion articuately connected to one end of the baffle body and articuately connected to the first triangular section, and a second baffle portion articuately connected to the opposite end of the baffle body and articuately connected to the second triangular portion, said first and second baffle portions being located downwardly from the base of the vent section to close the opening between adjacent roof rafters below the forward edge of the base, said first and second baffle portions being folded adjacent the roof rafters when the vent section is in its narrow position and forming extensions of the baffle body when the vent section is in its extended position.

7. The vent and baffle unit of claim 6 including: a lip articuately connected to the forward edge of the baffle body, said lip being adapted to engage the top of the top plate when the baffle section is located between adjacent roof rafters.

8. The vent and baffle unit of claim 1 wherein: the sheet member has elongated linear creases that articuately join the bottom wall with the side walls and articuately join the side walls with the first and second flanges.

9. The vent and baffle unit of claim 1 wherein: the sheet member has a transverse crease articuately connecting the bottom wall with the baffle means.

10. The vent and baffle unit blank of claim 1 wherein: each side wall has a generally triangular shape.

11. The vent and baffle unit of claim 1 wherein: the outlet end of the vent section has a broad V-shaped recess.

12. The vent and baffle unit of claim 1 wherein: the outlet end of the bottom wall has the apex of the triangle, said apex being located along the longitudinal center line of the vent section.

13. The vent and baffle unit of claim 12 wherein: the rear edge of the vent section has a V-shape, said V-shape having an apex that coincides with the apex of the triangular shaped bottom wall.

14. The vent and baffle unit for use with a structure having roof rafters, a top plate, a roof structure supported by the roof rafters, and an opening between the adjacent roof rafters connecting the soffit and attic comprising: a one-piece sheet member having a vent section providing an air passage between the soffit and attic and a baffle section for blocking the opening between adjacent roof rafters, except for the air passage, said vent section including a generally triangular bottom wall having opposite sides that converge in a rearward direction and a transverse forward edge, a first generally triangular side wall articuately joined to one side of the bottom wall, a second generally triangular side wall articuately joined to the other side of the bottom wall, each of said side walls having an elongated linear outside edge, a first flange articuately joined to the outside edge of the first side wall, a second flange articuately joined to the outside edge of the second side wall, and baffle means articuately joined to the forward edge of the bottom wall, said baffle means being extended in a downward direction from the transverse edge of the bottom wall toward the top plate to close the opening between the soffit and the attic when the vent and baffle unit is located between adjacent roof rafters, said vent section forming an air passage and said flanges being engageable with said roof to hold the vent section adjacent the roof structure.

15. The vent and baffle unit of claim 14 including: a transverse lip articuately connected to the baffle means, said lip adapted to engage the top plate when the baffle means is located between adjacent roof rafters to close the opening between the soffit and the attic.

16. The vent and baffle unit of claim 14 wherein: each flange is an elongated generally rectangular flat member.

17. The vent and baffle unit of claim 14 including: a first triangular section located adjacent the forward ends of the first flange and adjacent side wall, a first hinge connection movably connecting the first triangular section to the forward ends of the first flange and adjacent side wall, a second triangular section located adjacent the forward ends of the second flange and adjacent side wall, and a second hinge connection movably connecting the second triangular section to the forward ends of the second flange and adjacent side wall, said first and second hinge connections allowing the first and second flanges to be folded in inward facing direction whereby the vent section has a minimum width and allowing the flanges to be folded in an opposite outward direction whereby the vent section has a maximum width.

18. The vent and baffle unit of claim 14 wherein: the baffle means includes a baffle body, a first baffle portion articuately connected to one end of the baffle body and articuately connected to the first triangular section, and a second baffle portion articuately connected to the opposite end of the baffle body and articuately connected to the second triangular portion, said first and second baffle portions being located downwardly from the base of the vent section to close the opening between adjacent roof rafters below the forward edge of the base, said first and second baffle portions being folded adjacent the roof rafters when the vent section is in its narrow position and forming extensions of the baffle body when the vent section is in its extended position.

19. The vent and baffle unit of claim 18 including: a lip articuately connected to the forward edge of the baffle body, said lip being adapted to engage the top of the top plate when the baffle section is located between adjacent roof rafters.

20. The vent and baffle unit of claim 14 wherein: the sheet member has elongated linear creases that articuately join the bottom wall with the side walls and articulately join the side walls with the first and second flanges.

21. The vent and baffle unit of claim 14 wherein: the sheet member has a transverse crease articuately connecting the bottom wall with the baffle means.

22. The vent and baffle unit of claim 14 wherein: the outlet end of the vent section has a broad V-shaped recess.

23. The vent and baffle unit of claim 14 wherein: the bottom wall has a generally triangular shape with the outlet end of the bottom wall having the apex of the triangle, said apex being located along the longitudinal center line of the vent section.

24. The vent and baffle unit of claim 23 wherein: the rear edge of the vent section has a V-shape, said V-shape having an apex that coincides with the apex of the triangular shaped bottom wall.

25. A vent and baffle unit blank usable with a structure having adjacent roof rafters, a top plate, roof structure secured to the roof rafters, and an opening between adjacent roof rafters connecting the soffit and the attic comprising: a one-piece generally flat sheet member having a vent section and a baffle section, said vent section having a generally triangular bottom wall with opposite side edges and a forward edge, said generally triangular side walls articuately join to the opposite sides of the bottom wall, said side walls each having outside edges, a first flange articuately connected to one outside edge of one side wall, a second flange articuately connected to the side edge of the other side wall, a triangular section located adjacent the forward ends of the first flange and first side wall, first hinge means connecting the first triangular section to said first flange and first side wall, the second triangular section located adjacent the forward ends of the second side wall and second flange, a second hinge connection articuately connecting the forward ends of the second flange and second side wall to the second triangular section, said first and second hinge means extended in diverging rearwardly and outwardly directions from the baffle means, said baffle means having a main baffle articuately connected to the forward edge of the bottom wall, a first side baffle articuately connected to the first triangular section and the first end of the main baffle, and a second side baffle articuately connected to the second triangular section and the second side of the main baffle.

26. The vent and baffle unit blank of claim 25 including: a generally rectangular lip located forwardly of the main baffle, means articuately connecting the lip to the main baffle.

27. The vent and baffle unit blank of claim 25 wherein: the first and second hinge means comprise elongated linear web sections which allow the first and second flanges to be selectively folded in inward facing directions and in outward opposing directions.

28. A vent and baffle unit for use with a structure having adjacent roof rafters extended from a top plate to support roof structure and an opening between the adjacent roof rafters connecting the soffit and attic comprising: a one-piece sheet member having a vent section providing an air passage between the soffit and the attic and a baffle section closing the opening between the adjacent roof rafters at the forward end of the vent section, except for the air passage, said vent section including a bottom wall having opposite sides and a forward edge, side walls articuately joined to the opposite sides of the bottom wall, each side wall having a generally triangular shape, a first flange articuately joined to one side wall, a second flange articuately joined to the other side wall, said baffle section including a transverse baffle means articuately joined to the forward edge of the bottom wall, said side walls of the vent section being angularly relates to the bottom wall to form the vent passage and said first and second flanges being attachable to the roof structure, said baffle means of the baffle section being extended downwardly from the forward edge of the bottom wall to close the opening between adjacent roof rafters below the forward edge of the bottom wall, said bottom wall has a generally triangular shape with the outlet end of the bottom wall having the apex of the triangle, said apex being located along the longitudinal center line of the vent section.

29. The vent and baffle unit of claim 28 including: a transverse lip articuately connected to the baffle means, said lip adapted to engage the top plate when the baffle means is located between adjacent roof rafters to close the opening between the soffit and the attic, except for the air passage.

30. The vent and baffle unit of claim 28 including: a first triangular section located adjacent the forward ends of the first flange and adjacent side wall, a first hinge connection movably connecting the first triangular section to the forward ends of the first flange and adjacent side wall, a second triangular section located adjacent the forward ends of the second flange and adjacent side wall, and a second hinge connection movably connecting the second triangular section to the forward ends of the second flange and adjacent side wall, said first and second hinge connections allowing the first and second flanges to be folded in inward facing direction whereby the vent section has a minimum width and allowing the flanges to be folded in an opposite outward direction whereby the vent section has a minimum width.

31. The vent and baffle unit of claim 28 wherein: each flange is an elongated generally rectangular flat member.

32. The vent and baffle unit of claim 28 wherein: the baffle means includes a baffle body, a first baffle portion articuately connected to one end of the baffle body and articuately connected to the first triangular section, and a second baffle portion articuately connected to the opposite end of the baffle body and articuately connected to the second triangular portion, said first and second baffle portions being located downwardly from the base of the vent section to close the opening between adjacent roof rafters below the forward edge of the base, said first and second baffle portions being folded adjacent the roof rafters when the vent section is in its narrow position and forming extensions of the baffle body when the vent section is in its extended position.

33. The vent and baffle unit of claim 28 wherein: the outlet end of the vent section has a broad V-shaped recess.

34. The vent and baffle unit of claim 28 wherein: the rear edge of the vent section has a V-shape, said V-shape having an apex that coincides with the apex of the triangular shaped bottom wall.

* * * * *